US005832678A

United States Patent [19]

Newcomb et al.

[11] Patent Number: 5,832,678

[45] Date of Patent: Nov. 10, 1998

[54] SEISMIC PORTAL

[75] Inventors: Stephen L. Newcomb, Moore, Okla.; Frank Nishiura, Cupertino, Calif.; Trest Polina, Norman, Okla.; Tim Reed, Edmond, Okla.; Dale A. Schmitt, Oklahoma City, Okla.

[73] Assignee: Balco/Metalines, Inc., Wichita, Kans.

[21] Appl. No.: 731,762

[22] Filed: Oct. 18, 1996

(Under 37 CFR 1.47)

[51] Int. Cl.[6] ..... E04B 1/98

[52] U.S. Cl. ..... 52/167.1; 14/73.1; 14/73.5; 52/79.8; 52/177; 52/393; 52/396.05

[58] Field of Search ..... 52/79.7, 79.8, 52/167.1, 177, 393, 396.05; 14/73.1, 73.5

[56] References Cited

U.S. PATENT DOCUMENTS

| | | | |
|---|---|---|---|
| 3,887,292 | 6/1975 | Koster | 14/73.1 X |
| 4,605,106 | 8/1986 | Fyfe et al. | 14/73.5 X |
| 4,720,882 | 1/1988 | Gallo | 52/167.1 X |
| 5,490,356 | 2/1996 | Kemeny | 52/167.1 X |
| 5,537,790 | 7/1996 | Jackson | 52/393 |
| 5,644,879 | 7/1997 | Shreiner et al. | 52/393 |
| 5,682,712 | 11/1997 | Kemeny | 52/167.1 X |

FOREIGN PATENT DOCUMENTS

| | | | |
|---|---|---|---|
| 212869 | 1/1961 | Australia | 14/73.1 |

*Primary Examiner*—Christopher Kent
*Assistant Examiner*—Timothy B. Kang
*Attorney, Agent, or Firm*—Hovey,Williams, Timmons & Collins

[57] ABSTRACT

Portal apparatus (40) is provided for interconnection between adjacent first and second structures (32, 34) in order to maintain operative communication between the structures (32, 34) under seismic conditions. The apparatus (40) includes a portal assembly (36) together with coupling assemblies (38, 40) permitting translation and rotational movement of the portal assembly (36) about three orthogonal axes (X, Y and Z) in space. The first coupling assembly (38) serves to secure assembly (36) to structure (32) and permits rotation about and translation along the X axis, as well as rotation about the Y and Z axes. The second coupling assembly (40) slidably connects the remote end of assembly (36) to structure (34) and accommodates Y and Z axes translation.

22 Claims, 12 Drawing Sheets

48
32
44
54
58
221
46
42
36
30
212
218
50
56
52
214
3
216
38
172
88
220
84
248
4
284
282
280
72
76
70
90
34
74
62
64
24
40
244
66
X
Y
Z 100
94
98
92
116
246
226
274
276
278
284
282
280
290
292
294
286
288
242
240
230
238
232
226

164
208
162
168
170
220
158
156
206
166
182
210
128
176
126
60
154
96
174
160
172
100
102
104
122
296
124

SEISMIC PORTAL

BACKGROUND OF THE INVENTION

1. Field of the Invention

The present invention is broadly concerned with portal apparatus designed to span the distance between adjacent first and second structures subject to sudden movement such as that caused by a seismic event. More particularly, the invention includes a portal assembly designed to support traffic between the first and second structures, and which is coupled to the structures by means which accommodates significant translational rotational movement of the portal assembly about three orthogonal axes in space while maintaining the interconnection between the first and second structures.

2. Description of the Prior Art

Areas such as the western part of the United States are prone to frequent earthquakes of varying severity ranging from minor tremors to catastrophic seismic events. Realization of this fact has resulted in increasingly stringent building codes in these areas, requiring erection of buildings resistant to earthquake damage.

For example, new regulations in the State of California require certain types of hospitals and emergency care facilities to be constructed on resilient, earthquake-resistant bearings. Moreover, new construction of this type may be required to be sectionalized, i.e., constructed as relatively small, separately supported building structures interconnected by walkways or portals. In such instances, a problem is presented by virtue of the need to insure that the portal apparatus interconnecting the separate building structures can accommodate a significant amount of relative movement between the buildings under earthquake conditions, while nevertheless maintaining the ability to support traffic.

There is accordingly a real and unsatisfied need in the art for portal apparatus specifically designed to span the distance between adjacent building structures and which includes specialized coupling assemblies which can safely accommodate significant translational and rotational movement about three orthogonal axes in space.

SUMMARY OF THE INVENTION

The present invention overcomes the problems outlined above, and provides portal apparatus specifically designed for use in earthquake prone areas for the purpose of interconnecting first and second building structures. Broadly speaking, such apparatus includes a portal assembly presenting a pair of laterally spaced apart side margins and a pair of opposed ends and having an elongated floor panel adapted to support traffic thereover between the structures. The overall apparatus further includes means coupling the opposed ends of the portal assembly to the first and second structures respectively. This coupling means is designed to accommodate significant translation and rotational movement of the portal assembly about three orthogonal axes in space while maintaining the interconnection of the portal assembly with the first and second structures.

In preferred forms, the portal assembly includes a pair of upright sidewalls operably coupled with the floor panel and a ceiling panel extending between and operably coupled with the sidewalls, thus defining an elongated passageway presenting opposed portal openings. Each of the floor and ceiling panels, and the sidewalls, advantageously includes lightweight resilient honeycomb fill structure as a part of the construction thereof.

In preferred forms, the coupling means for the portal assembly includes means supporting one end of the portal assembly to the first building structure for translational movement of the latter along a first horizontal axis transverse to the longitudinal axis of the portal assembly. Shiftable curtain means is operably coupled with the lateral side margins of the one end of the portal assembly, for movement of the curtain means along the first axis. In this fashion, if the portal assembly is shifted laterally and out of registry with the building structure entryway, the curtain means comes into play to cover the opening created and to prevent inadvertent passage through the opening. Advantageously, this coupling structure includes an elongated track pin disposed below the floor panel with a main bearing block coupled to the floor panel and receiving the track pin for shifting movement therealong. In order to provide another degree of freedom, the main bearing block is preferably pivotal about the longitudinal axis of the track pin.

Rotation about a vertical axis, is provided by equipping the main bearing block with an upright pin extending upwardly and being received by the floor panel of the portal assembly.

The opposite end of the portal assembly is coupled to the second building structure so that the floor panel is shiftable relative to the latter. To this end, a series of slide tracks are provided which support the end of the floor panel together with a series of upright support beams; the latter engage and support a slider plate secured to the building structure and which extends over a portion of the floor panel. These guide beams are shiftable toward and away from the end of the floor panel under the influence of movement of the building structures toward and away from each other to give continued support to the slider plate under all credible seismic event conditions.

DETAILED DESCRIPTION OF THE DRAWINGS

Turning now to the drawings, and particularly FIGS. 1, 2, 4 and 8, a portal apparatus 30 is depicted for spanning the distance between first and second adjacent building structures 32, 34. The apparatus 30 is designed to maintain the operative interconnection between the structures 32, 34 under credible seismic events for the locale in question. To this end, a passageway-defining portal assembly 36 is employed, together with first and second coupling assemblies 38, 40 for connecting the respective ends of assembly 36 to the first and second building structures 32, 34.

Figure 1:
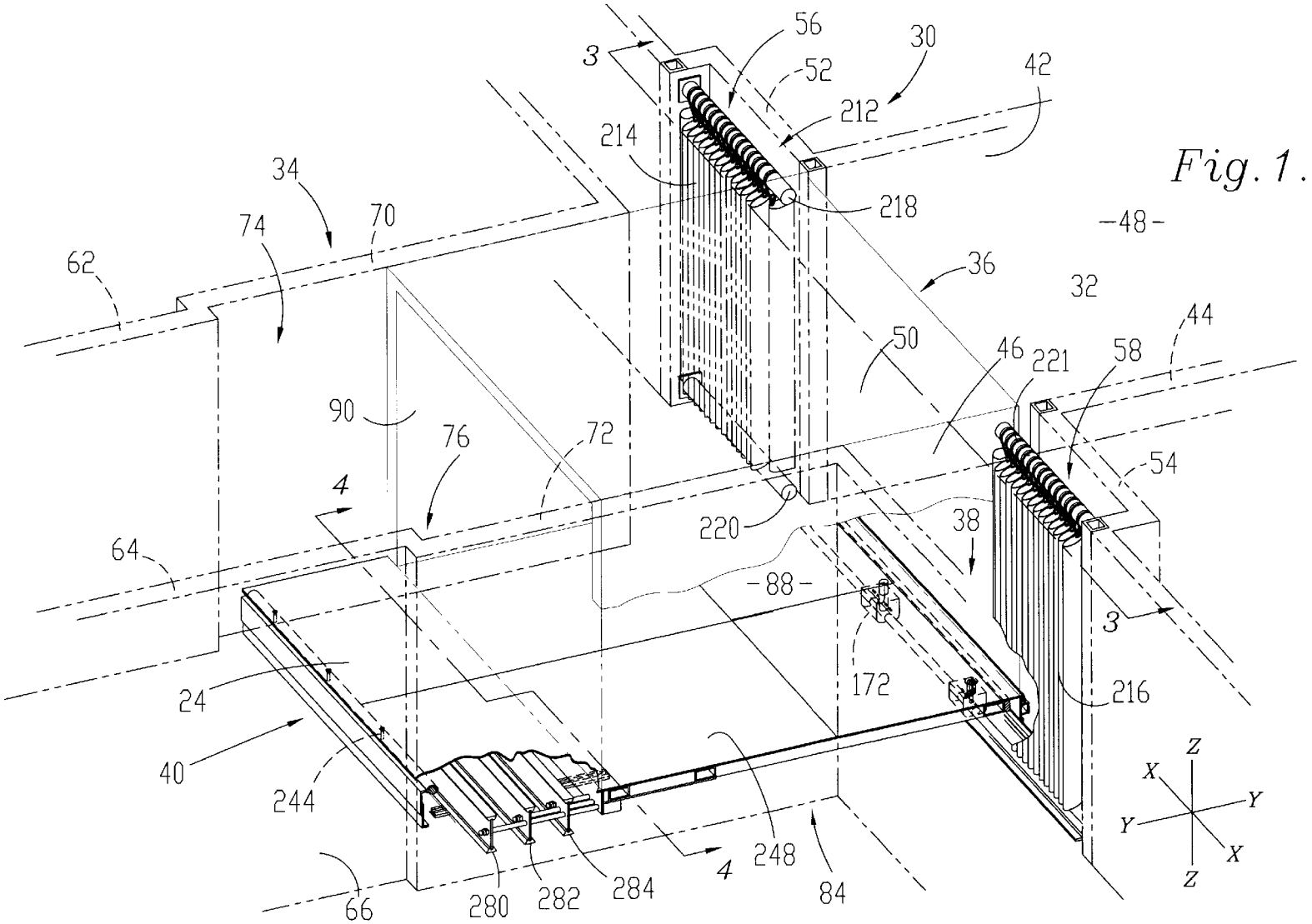
FIG. 1 is a schematic isometric view, with parts broken away, illustrating a portal apparatus in accordance with the invention operably coupled between and spanning adjacent first and second building structures.

In more detail, the first building structure 32 includes spaced walls 42, 44, floor 46 and ceiling 47 with cooperatively define a hallway 48 terminating in a portal entryway 50. As best seen in FIG. 1, the walls 42, 44 terminate in generally L-shaped sections 52, 54 adjacent entryway 50 in order to define corresponding narrow, lateral spaces 56, 58. In addition, the first building structure 32 presents a transversely extending metallic shoulder base 60 below entryway 50 (see FIG. 2).

Figure 2:
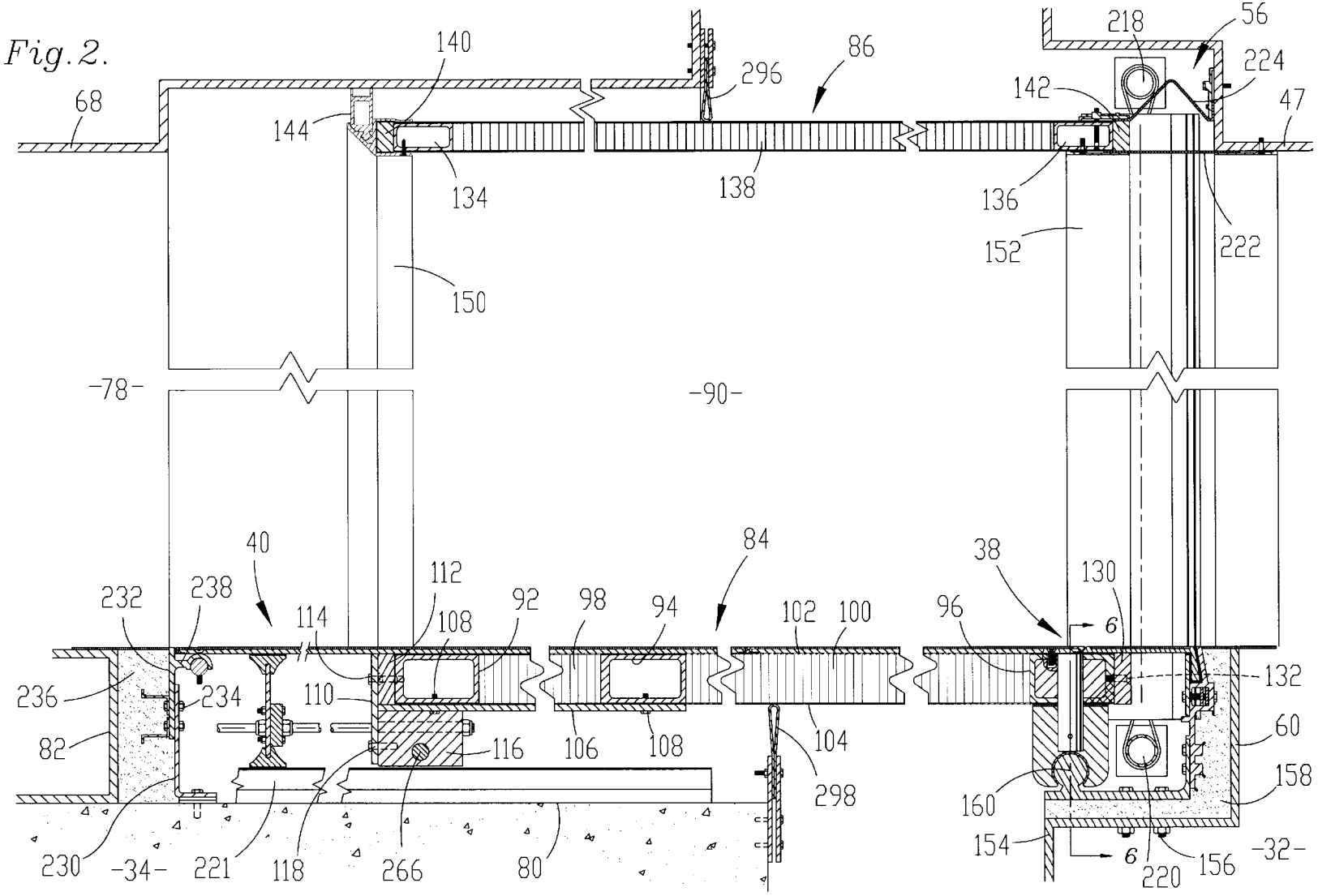
FIG. 2 is a fragmentary vertical sectional view of the portal apparatus and building structures illustrated in FIG. 1.
Figure 3:
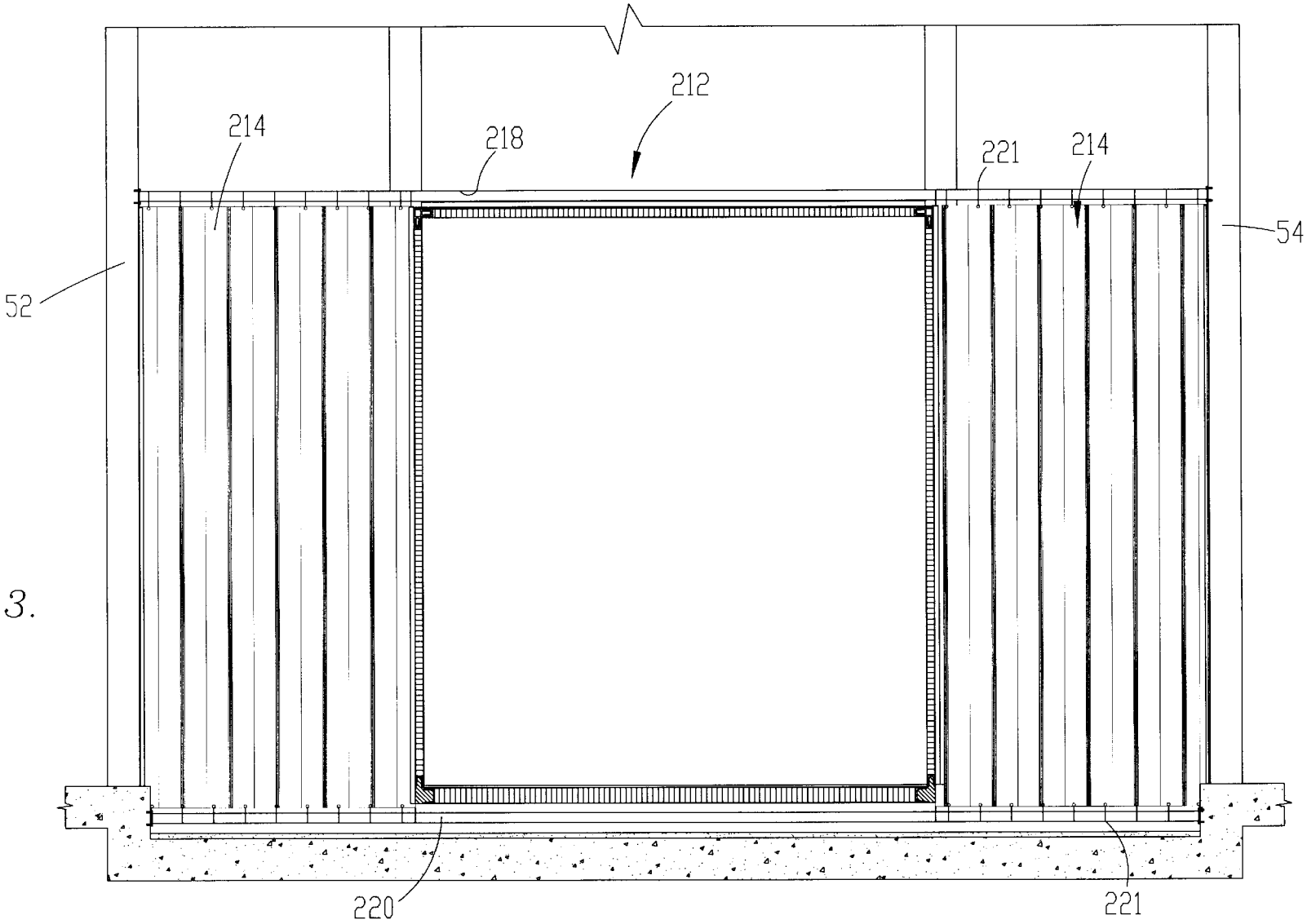
FIG. 3 is a vertical sectional view taken along line 3—3 of FIG. 1 and illustrating the portal curtain assembly.
Figure 5:
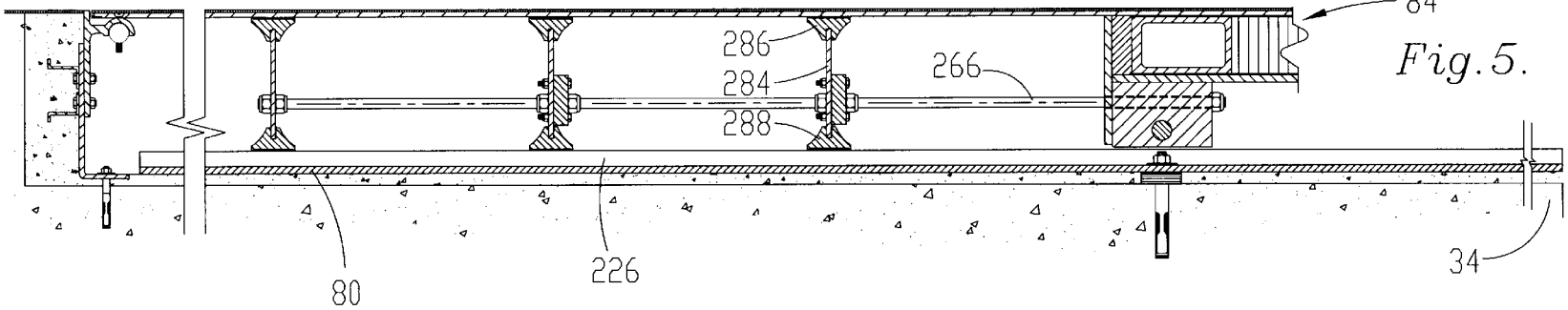
FIG. 5 is a fragmentary vertical sectional view taken along line 5—5 of FIG. 4.

Second building structure 34 likewise includes laterally spaced apart hallway-defining walls 62, 64, floor 66 and ceiling 68. As illustrated in FIG. 1, the walls 62, 64 include offset segments 70, 72 which cooperatively define a pair of elongated fore and aft extending recesses 74, 76. The walls 62, 64, floor 66 and ceiling 68 cooperatively define a portal entryway 78 adjacent the inner margins of the offset segments 70, 72. As best seen in FIG. 2, the second building structure 34 presents a ledge or shoulder 80 which extends essentially the full length of the offset segment 70, 72. In addition, an upright mounting plate 82 is secured to shoulder 80 as shown.

Portal assembly 36 broadly includes floor panel 84, ceiling panel 86 and laterally spaced sidewalls 88, 90. As best seen in FIG. 1, the walls 88 and 90, floor panel 84 and ceiling panel 86 cooperatively define an elongated passageway normally in communication with the entryway 50 and 78. Further, it will be observed that a substantial portion of the portal assembly 36 is received within second building structure 34, with the offset wall segments 70 and 72 accommodating the portal assembly.

In more detail, it will be seen that floor panel 84 includes a total of three elongated, axially spaced apart, laterally extending metallic aluminum reinforcing boxes 92, 94, 96. First and second honeycomb segments 98, 100 are situated respectively between boxes 92 and 94, and between boxes 94 and 96. Each of these honeycomb segments is identical, and is made up of a plurality of synthetic resin serpentine walls each presenting a series of alternating, oppositely directed peaks along the lengths thereof, with the walls being connected peak-to-peak to define a series of cells between the walls. This type of honeycomb material is commercially available and is sold by Hexcel, Inc. of Pleasanton, Calif. In plan configuration, the honeycomb filler segment is at least about 90% voids, thereby allowing the segments to undergo significant compression. By the same token, the segments can resiliently expand as required. The upper and lower surfaces of the honeycomb segments 98, 100, are each covered with an imperforate sheet 102, 104.

The left-hand end of floor panel 84 as viewed in FIG. 2, is equipped with a metallic support plate 106 which extends under reinforcing boxes 92 and 94 and is affixed thereto by means of fasteners 108. In addition, a depending support plate 110 is provided adjacent the extreme left-hand of floor panel 84, and is secured to beam 92 by means of shim block 112 and fastener 114. A pair of endmost, apertured mounting blocks 116 are secured adjacent the underside of plate 106 by means of fasteners 118 extending through depending plate 110. The blocks 116 are in laterally spaced relationship and are each located adjacent a corresponding side margin of the floor panel.

Figures 8, 9:
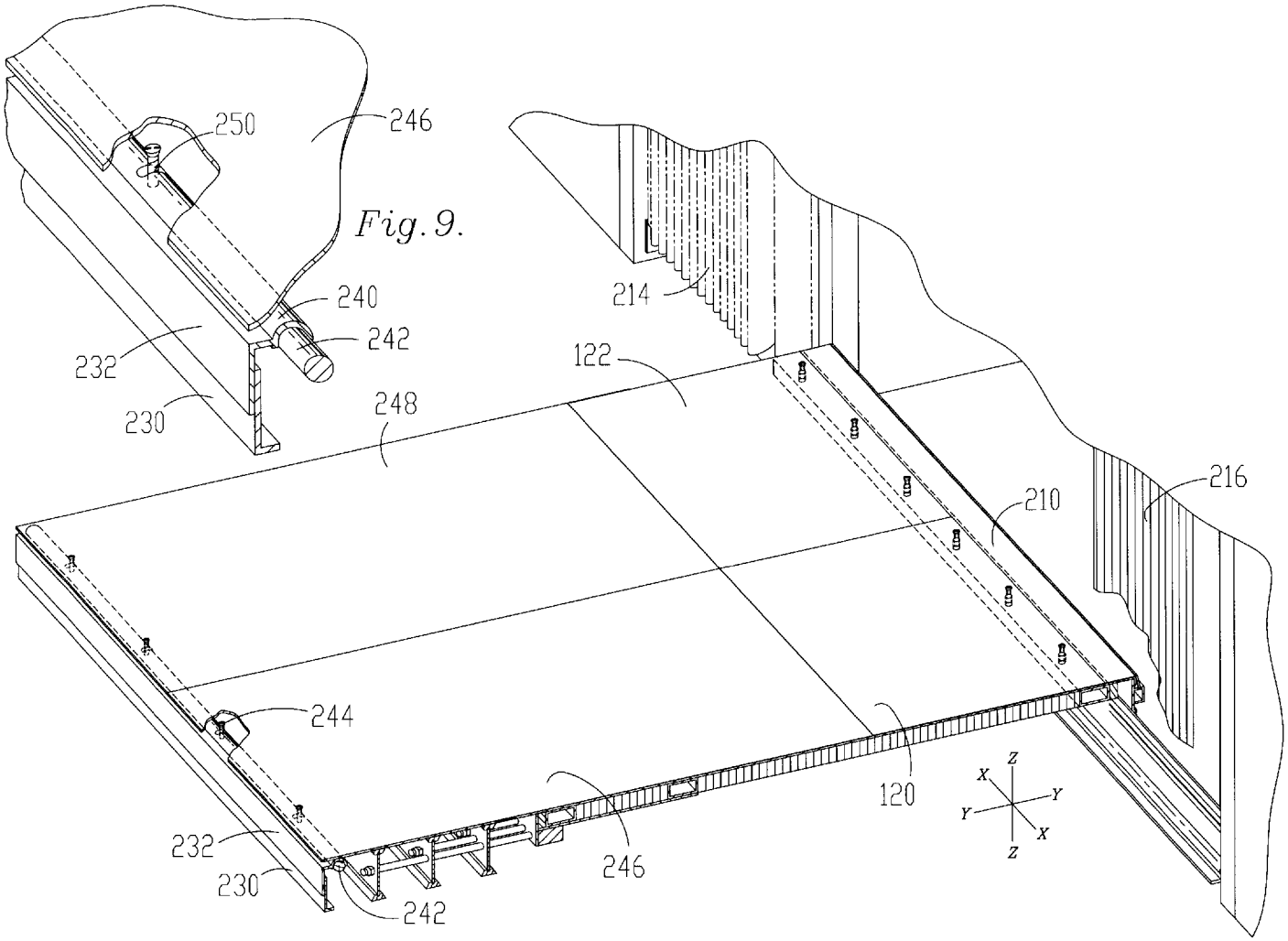
FIG. 8 is an isometric view with parts broken away for clarity depicting the floor panel forming a part of the portal apparatus of the invention.
FIG. 9 is an enlarged, fragmentary isometric view with parts broken away for clarity and illustrating in detail the connection of the slider plates to the second building structure.
Figures 10, 11:
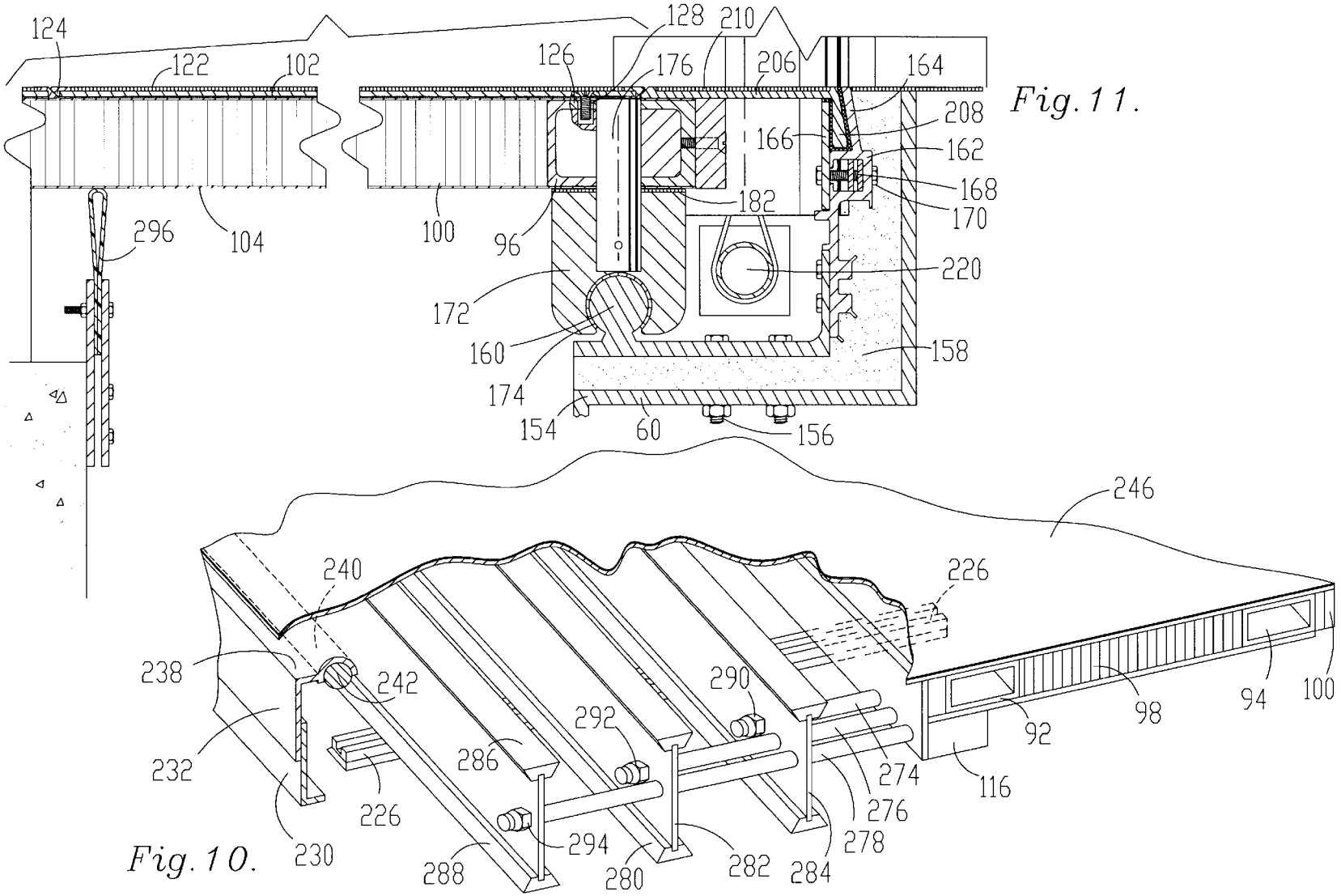
FIG. 10 is a fragmentary isometric view with parts broken away and depicting in detail the shiftable beam support assembly for the slider plates.
FIG. 11 is a fragmentary vertical sectional view illustrating in detail the primary bearing block assembly and traveling threshold plate assemblies.

Referring to FIGS. 8 and 11, a pair of side-by-side floater plate sections 120, 122 are situated atop honeycomb fill section 100. Each of these floater plates includes a beveled trailing edge 124, and is affixed to reinforcing box 96 in a manner to permit limited lifting or floating action of the plate sections as will be described. To this end, the box 96 (see FIG. 11) is provided with a total of six oversized, non-threaded sockets 126 which receive corresponding depending bolts 128 threaded through the forward edges of the floater plate sections 120, 122. This arrangement allows the floater plate sections to rise vertically, but prevents significant fore and aft shifting of the floater plate sections.

The right-hand end of floor panel 84 as viewed in FIG. 2 includes an elongated reinforcing slab 130 affixed to endmost reinforcing box 96 by fasteners 132.

Ceiling panel 86 is similar in some respects to the floor panel and includes a pair of elongated, transversely extending hollow aluminum reinforcing boxes 134, 136, which terminate in corner extrusions 137 serving to interconnect the ceiling panel with the upright side panels 88, 90. A honeycomb fill segment 138 is located between the reinforcing boxes 134, 136. Respective endmost frame elements 140, 142 are secured to the boxes 134, 136 as shown. Frame element 140 supports a sliding neoprene seal member 144 which engages ceiling 68 (see FIG. 2).

The sidewalls 88 and 90 are essentially similar to ceiling panel 86, in that they include reinforcing boxes and honeycomb fill sections. In particular (see FIG. 4) the side walls 88 and 90 each include a honeycomb fill segment 146, 148 which extend downwardly essentially the full height of the sidewall. Metallic corner connectors 149 serve to interconnect the side panels 88, 90 with floor panel 84 as shown. A pair of elongated, upright frame plates 150 are secured to the ends of reinforcing box 134 and extends downwardly along sidewalls 88, 90 to abut the upper surface of floor panel 84. In like manner, a pair of opposed frame plates 152 are secured to reinforcing box 136 and extend downwardly along the sidewalls to abut floor panel 84.

The first coupling assembly 38 is designed to connect one end of portal assembly 36 with first building structure 32. As best seen in FIG. 2, the assembly 38 includes an angle support plate 154 which is located in spaced relationship to shoulder base 60 and is affixed thereto by fasteners 156.

Grout fill 158 is provided between the shoulder plate 60 and support plate 154 as shown. The support plate 154 has an elongated, transversely extended track pin 160 affixed to the upper surface thereof. Additionally, the upper margin of plate 154 presents a transversely extending recess 162 as well as an upwardly extending, oblique segment 164. The inboard face of recess 162 is covered by plate 166. A resilient fastening assembly including spring members 168 and threaded fastener 170 is employed to resiliently urge plate 166 rightwardly as viewed in FIG. 11.

Figure 13:
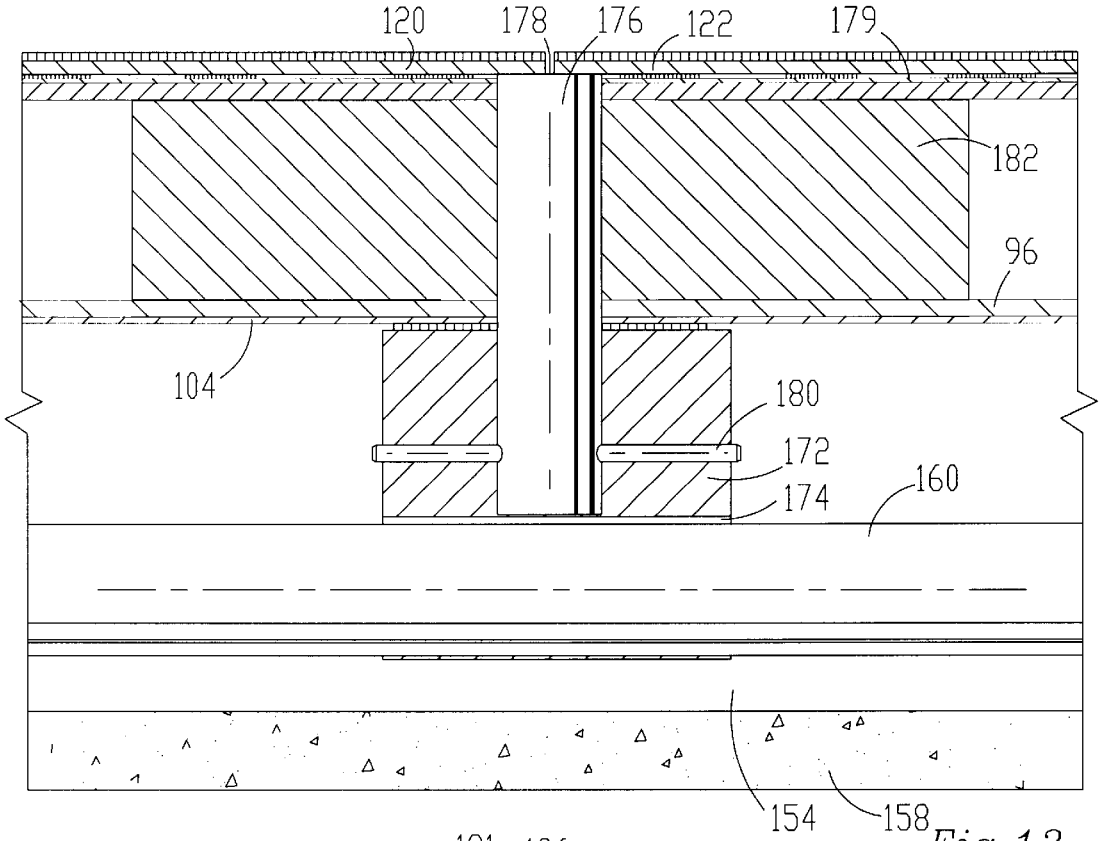
FIG. 13 is an enlarged, fragmentary vertical sectional view depicting the primary bearing assembly.

The overall coupling assembly 38 also includes a centrally located main bearing block 172 which includes a downwardly opening, arcuate passageway 174 therein receiving pin 160. The inner defining surface of the passageway 174, as well as the upper surface of the bearing block 172, are provided with a Teflon coating to facilitate relative movement between the bearing block and the adjacent components. Referring particularly to FIGS. 11 and 13, it will be observed that block 172 supports an upright center pivot pin 176 which extends upwardly through reinforcing box 96. The upper flattened surface 178 of pin 176 supports the forward edge of floater plate sections 120, 122. Teflon tape 177 is provided between the upper surface of panel 84 and the sections 120, 122. In order to provide proper mechanical support for the pin 176, a transverse roll pin 180 is used to affix pin 176 to bearing 172. Moreover, the central section of reinforcing box 96 is provided with an aluminum fill 182.

Figure 12:
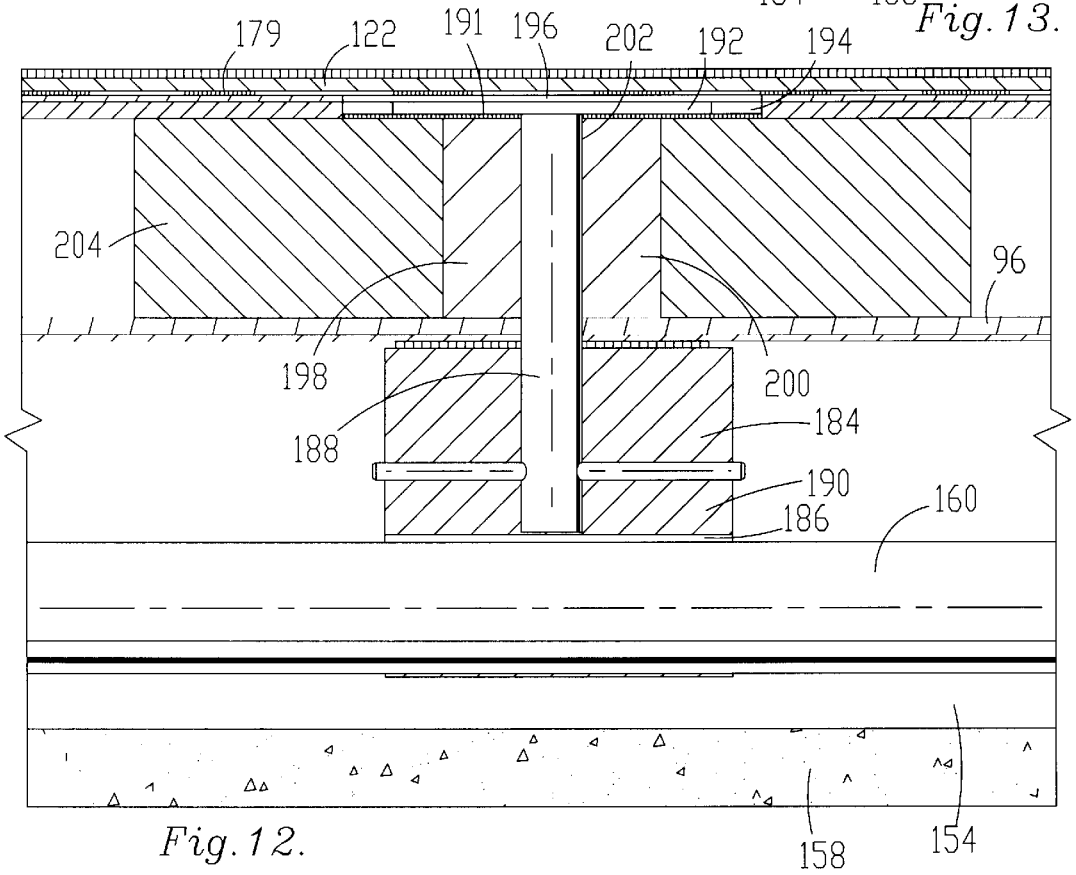
FIG. 12 is an enlarged, fragmentary vertical sectional view depicting one of the auxiliary bearing assemblies.

A pair of identical, laterally spaced apart auxiliary bearing blocks 184 are also provided beneath box 96. Each of the blocks 184 includes a downwardly opening, Teflon-coated passageway 186 sized to slidably receive pin 160, as well as a Teflon coated upper surface. Each block 184 also supports an upstanding guide pin 188, which is affixed to the corresponding block by means of roll pin 190. As best seen in FIG. 12, each guide pin 188 extends upwardly through box 96 and has a thin, radially enlarged retention disk 192 which engages an underling Teflon coating 191. The upper wall of box 96 is provided with a circular opening 194 to accommodate disk 192. A fill plate 196 is positioned atop disk 192 as shown, and serves as a partial Teflon coated bearing surface for the floater plate sections 120, 122. At the region of each pin 188, the box 96 is provided with a pair of spaced metallic filled segments 198, 200 which cooperatively define a passageway 202 permitting limited, arcuate, fore and aft movement of pin 188. The segments 198, 200 are in turn surrounded by a metallic fill 204.

The first coupling assembly 38 further includes a traveling threshold plate 206 which extends from plate 154 into overlying relationship with box 96. As best seen in FIG. 11, the threshold plate 206 includes a depending, somewhat triangularly shaped, Teflon coated insert 208 which is situated between resilient plate 166 and oblique wall segment 164 and is thereby biased to the FIG. 11 position. The plate 206 also has a planar trailing segment 210 which extends to a point which extends to a point closely adjacent the forward edges of floater plate sections 120, 122.

The first coupling assembly 38 also includes a curtain assembly 212 comprising a pair of lateral pleated curtains 214, 216. The latter are conventionally supported by means of upper and lower transverse curtain rods 218, 220 and hangers 221. Curtain 214 is affixed between the short leg of L-shaped section 52 and portal sidewall 90, whereas curtain 216 is similarly affixed between segment 54 and portal sidewall 88.

First coupling assembly 38 is completed by provision of a first, essentially planar and resilient neoprene seal 222 which is affixed to reinforcing box 136 of sealing panel 86 and to ceiling 46 (see FIG. 2). Additionally, another neoprene seal 224 is secured to the upper surface of box 136 and to a vertical panel of ceiling 47.

The second coupling assembly 40 is provided to operatively secure the adjacent end of portal assembly 30 to second building structure 34. The assembly 40 has a plurality of laterally spaced apart, axially extending track members 226 which are affixed to shoulder 80 of building structure 34 by means of conventional concrete anchors 228. As best seen in FIG. 2, the track members 226 are disposed beneath the mounts 116 and extend leftwardly for substantial distance beyond the left-hand end of floor panel 84. An upright, generally L-shaped end plate 230 is secured to shoulder 80 and extends upwardly therefrom. A mating plate 232 is coupled to plate 230 by means of fasteners 234. The plates 230, 232 form the extreme left-hand end of coupling structure 40, and grout fill 236 is employed to fill the space between these inner connected plates 230, 232 and adjacent plate 82.

Upper end plate 232 includes a rightwardly extending projection 238 which terminates in an arcuate downwardly opening portion 240. An elongated, tapped connection rod 242 is positioned within the confines of portion 240 and is employed, along with attachment screws 244, to secure slider plate sections 246, 248. Referring particularly to FIG. 9, it will be observed that the portion 240 is provided with arcuate slots 250 which are in register with the tapped bores within connection rod 242. The extreme left-hand end of slider plate sections 246, 248 are provided with openings for passage of the connection screws 244, and the depicted arrangement allows secure connection of the slider plate sections to the connection rod 242, and hence to rigid plate 232.

Figure 4:
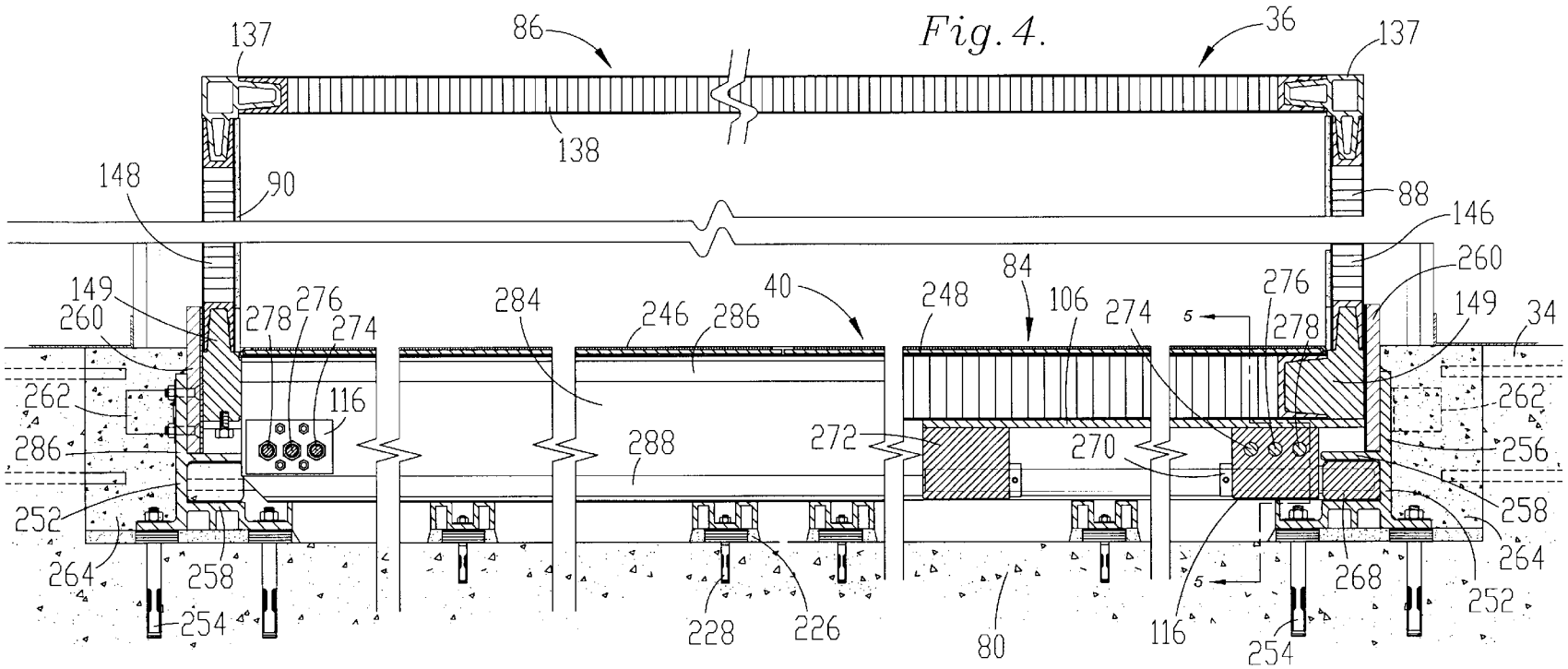
FIG. 4 is a fragmentary vertical sectional view taken along line 4—4 of FIG. 1.
Figures 6, 7:
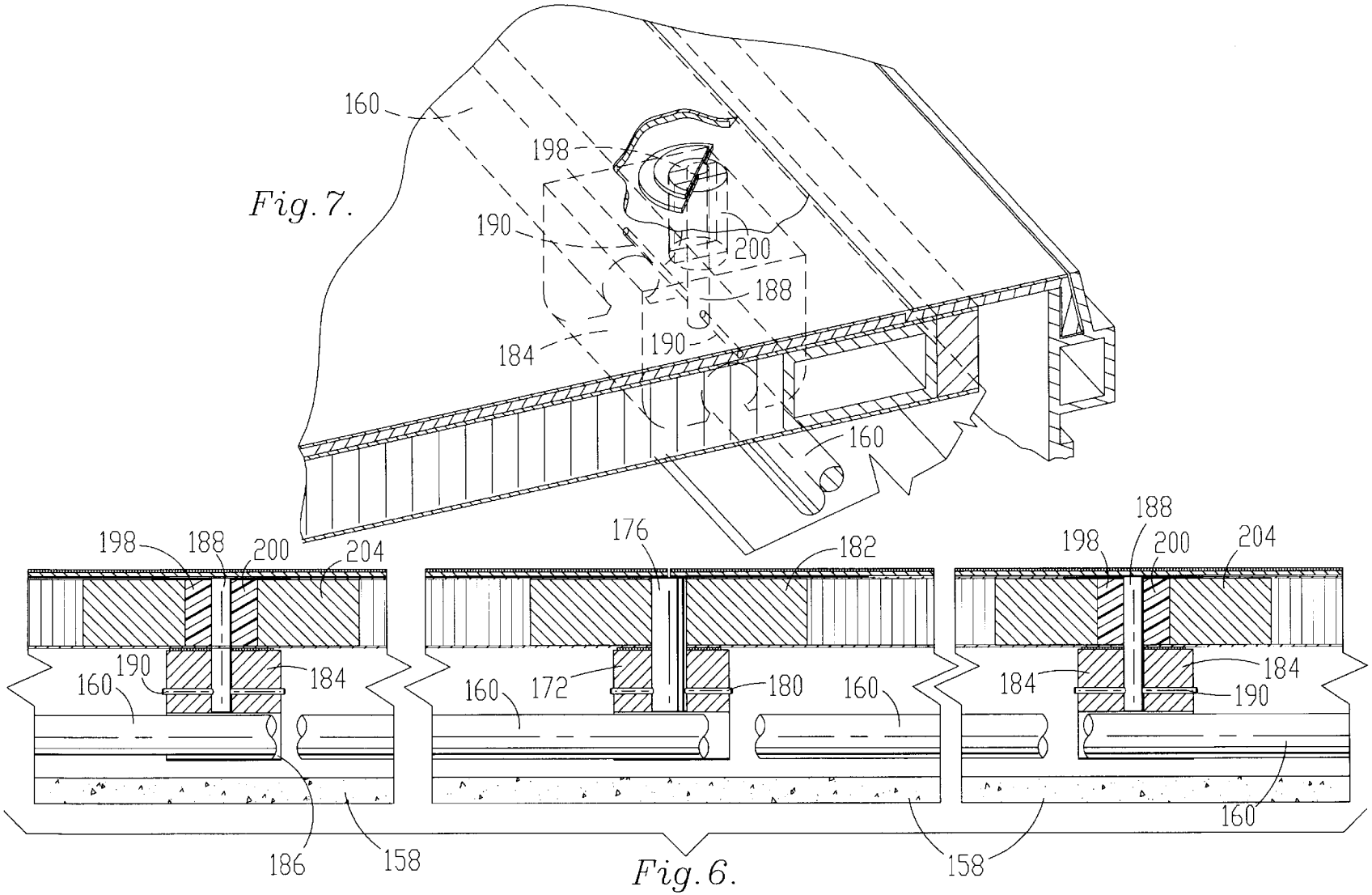
FIG. 6 is a fragmentary vertical sectional view taken alone line 6—6 of FIG. 2.
FIG. 7 is a fragmentary isometric view partially in phantom and illustrating in detail an auxiliary bearing block assembly.

Referring particularly to FIG. 4, it will be observed that the assembly 40 further includes a pair of upright plate members 252 respectively disposed on opposite sides of portal assembly 36 which are secured to shoulder 80 by means of anchors 254. Each plate member 252 includes an upstanding wall 256 as well as an inwardly opening, elongated track section 258 which extends along the length of portal assembly 36. A bearing plate 260 is secured to the inner face of each wall 256 and provides a vertical bearing surface for the portal assembly 36. Finally, each of the plate members 252 is equipped with a concrete anchor 262 which is embedded within grout 264 applied during installation of portal apparatus 30.

An elongated, transversely extending axle 266 extends the full width of portal assembly 36 and is received within each corresponding track section 258. In this regard, a tubular, Teflon coated bearing cap 268 is applied over each extreme end of the axle 266, and the caps 268 are received within the track sections 258 so as to assure smooth, fore and aft sliding motion of the axle 266 as required. As best seen in FIG. 4, the axle 266 is situated above the track members 226. The axle 266 passed through previously described mounts 116, and is secured by locking collars 270. In addition, a stabilizing mounting block 272 receives axle 266 and engages plate 106 as shown.

Each of the endmost mounting blocks 116 is provided with three laterally spaced bores which receive corresponding guide rods 274, 276, 278. These guide rods extend leftwardly as viewed in FIGS. 2 and 10 and are of differing lengths. A total of three laterally extending support beams 280, 282, 284 are positioned leftwardly of floor panel 84 and have upper and lower Teflon coated slide pads 286, 288. The underside of pads 288 rest upon the tracks 226, whereas the upper surfaces of the pad 286 engage and support slider plate sections 246, 248. As best illustrated in FIG. 10, beam 284 is operatively coupled with the shortest guide rods 274 by means of nuts 290; beam 282 is likewise coupled to intermediate length rods 276 via nuts 292; and beam 280 is coupled to longest rods 278 by means of nuts 294. As shown, each corresponding pair of rods extends through the associated beam and the nuts 290–294 are applied to the rods and engage the faces of the beams remote from floor panel 84.

In order to provide a weather-tight seal above and below the portal assembly 36, elongated upper and lower neoprene seals 296, 298 are respectively affixed to ceiling 68 and shoulder 80 of second building structure 34. The seals 296, 298 engage the upper and lower surfaces of ceiling panel 86 and floor panel 84, respectively.

Operation

Figure 14:
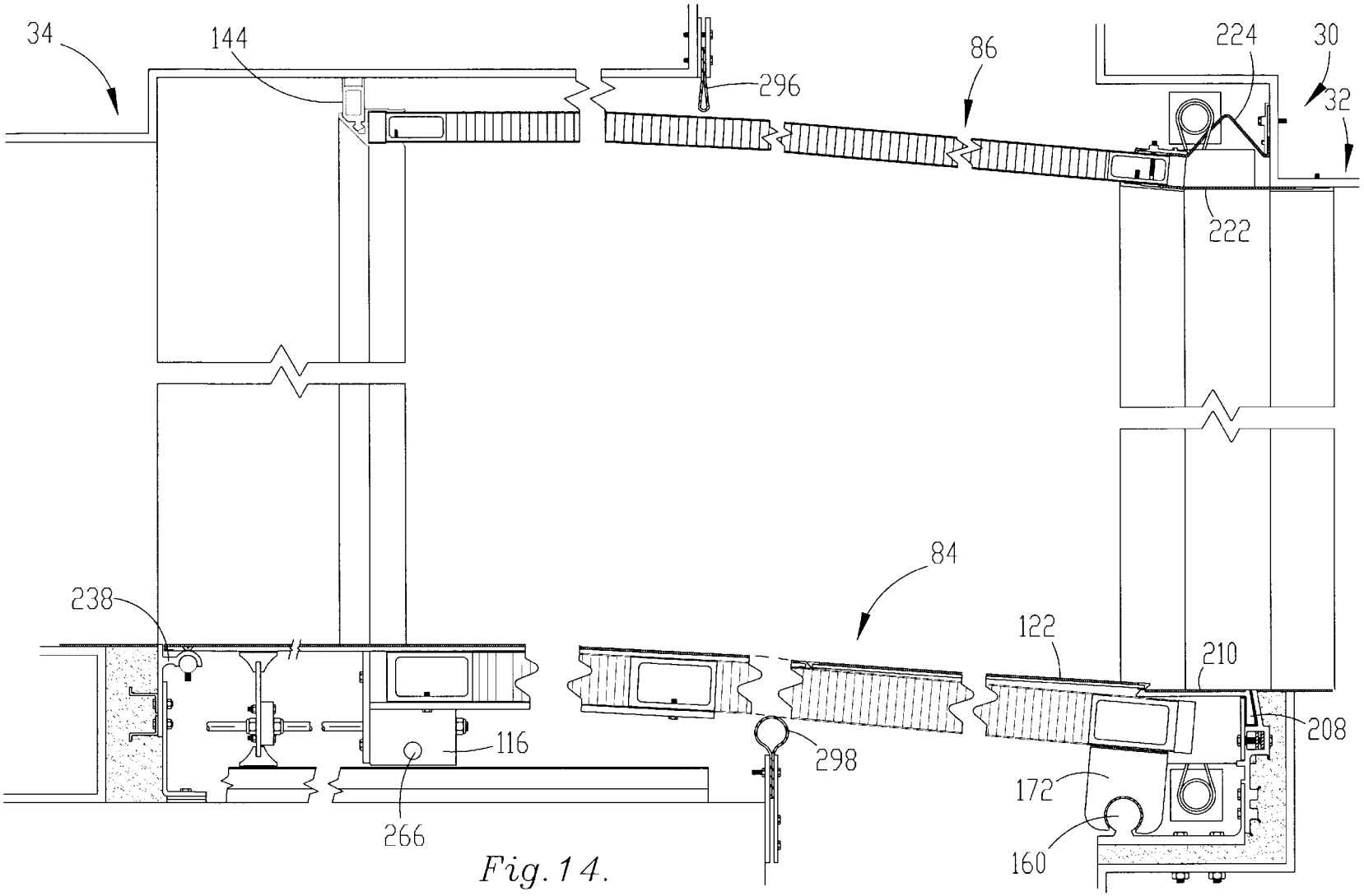
FIG. 14 is a fragmentary view in partial vertical section illustrating the portal apparatus of the invention in accommodating X-axis rotation and Z-axis translation.
Figure 15:
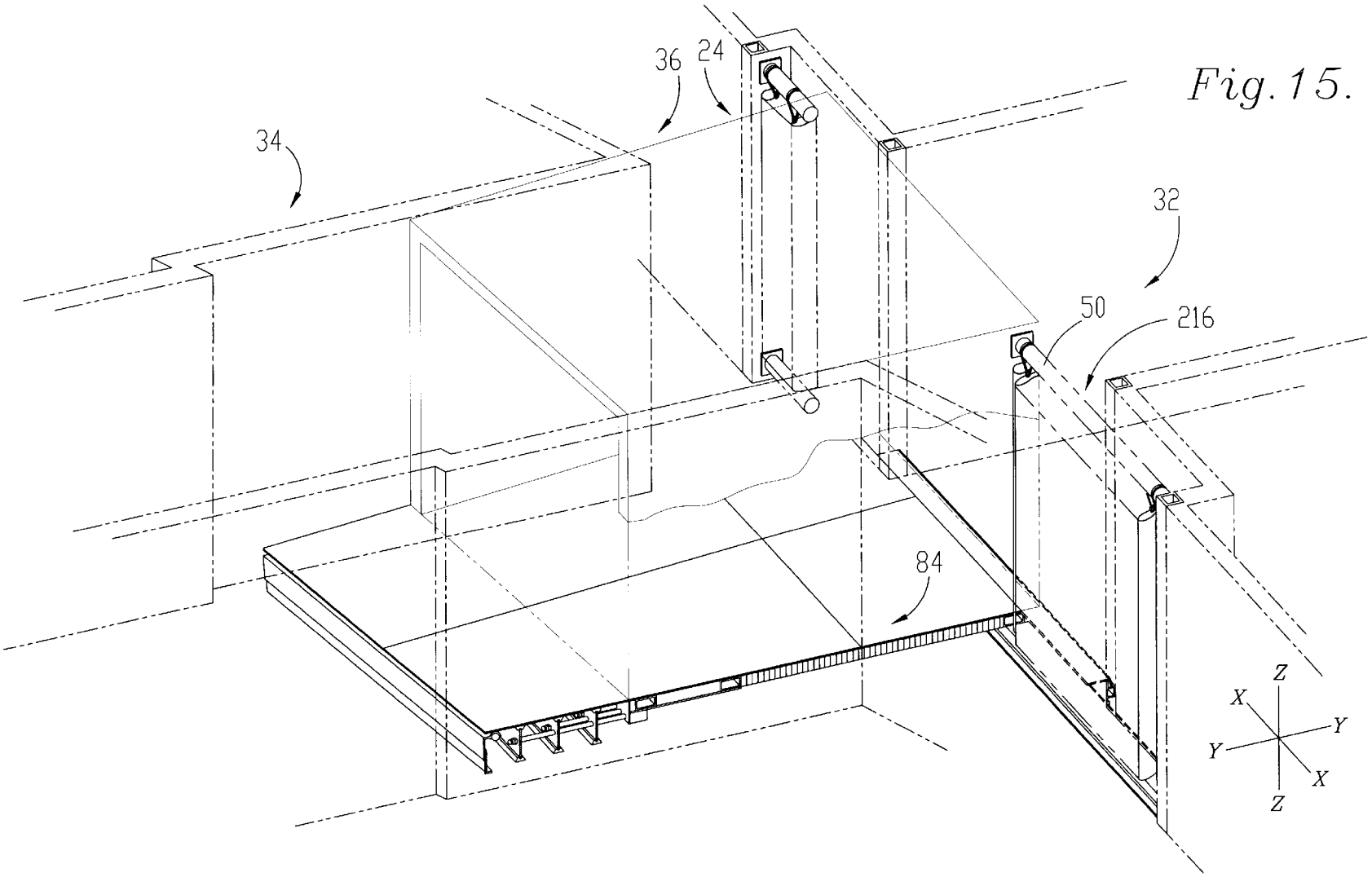
FIG. 15 is a fragmentary isometric view illustrating the portal apparatus of the invention accommodating X-axis translation and Y-axis rotation.

The operation of portal apparatus 30 is best understood from a consideration of FIGS. 14–17. That is, the portal assembly is designed to accommodate significant translation and rotational movement thereof about three orthogonal axes in space while maintaining the interconnection of the portal assembly with the first and second building structures 32, 34. With particular reference to FIG. 15, it will be observed that three such axes X, Y and Z have been defined, and in the ensuing discussion, this orientation of the axes is assumed.

FIG. 14—X-Axis Rotation/Z-Axis Translation

The condition depicted in FIG. 14 may occur when, under the influence of a seismic event, second building structure 34 rises relative to first building structure 32. In order to accommodate this relative movement, the portal assembly 30 must rotate about this X-axis and translate along the Z-axis.

In particular, under such conditions, the main and auxiliary bearing blocks 172 and 184 rotate about pin 160 causing the right-hand end of floor panel 84 to move downwardly. Under this condition, the floater panel sections 120, 122 may elevate slightly (depending upon the degree of Z-axis translation), with the result being that the leftward edge of planar section 210 passes beneath the leading edge of the floater plate sections. Alternately, the threshold plate 208 may be pivoted upwardly, such movement being resisted by the shape of insert 208 and the resiliently maintained plate 166. In addition, the seals 222, 224 may stretch or expand as necessary, and likewise seal 144 may compress. The ceiling panel 85 may move downwardly away from upper seal 96, and lower seal 298 may become compressed.

FIG. 15—X-Axis Translation/Y-Axis Rotation

The condition depicted in FIG. 15 can occur when the first and second building structures 32, 34 move in a relative lateral and/or rotational sense, such that the portal assembly 36 becomes offset from entryway 50.

Under these assumptions, the portal assembly 36 accommodates movement by translation of the bearing blocks 172, 184 along the length of pin 160. This causes compression of curtain 214 and corresponding extension of opposed curtain 216. In this fashion, the offset between the portal assembly 36 and entryway 50 is covered, thus preventing creation of a dangerous opening astride the portal assembly.

Y-axis rotation is accommodated by virtue of the sectionalized nature of the slider and floater plates, creating a natural joint between the sections along the length of the floor panel 84. Moreover, a degree of torsional flexibility is provided by the construction of the portal assembly 36, which facilitates accommodation of Y-axis rotation.

Figure 16:
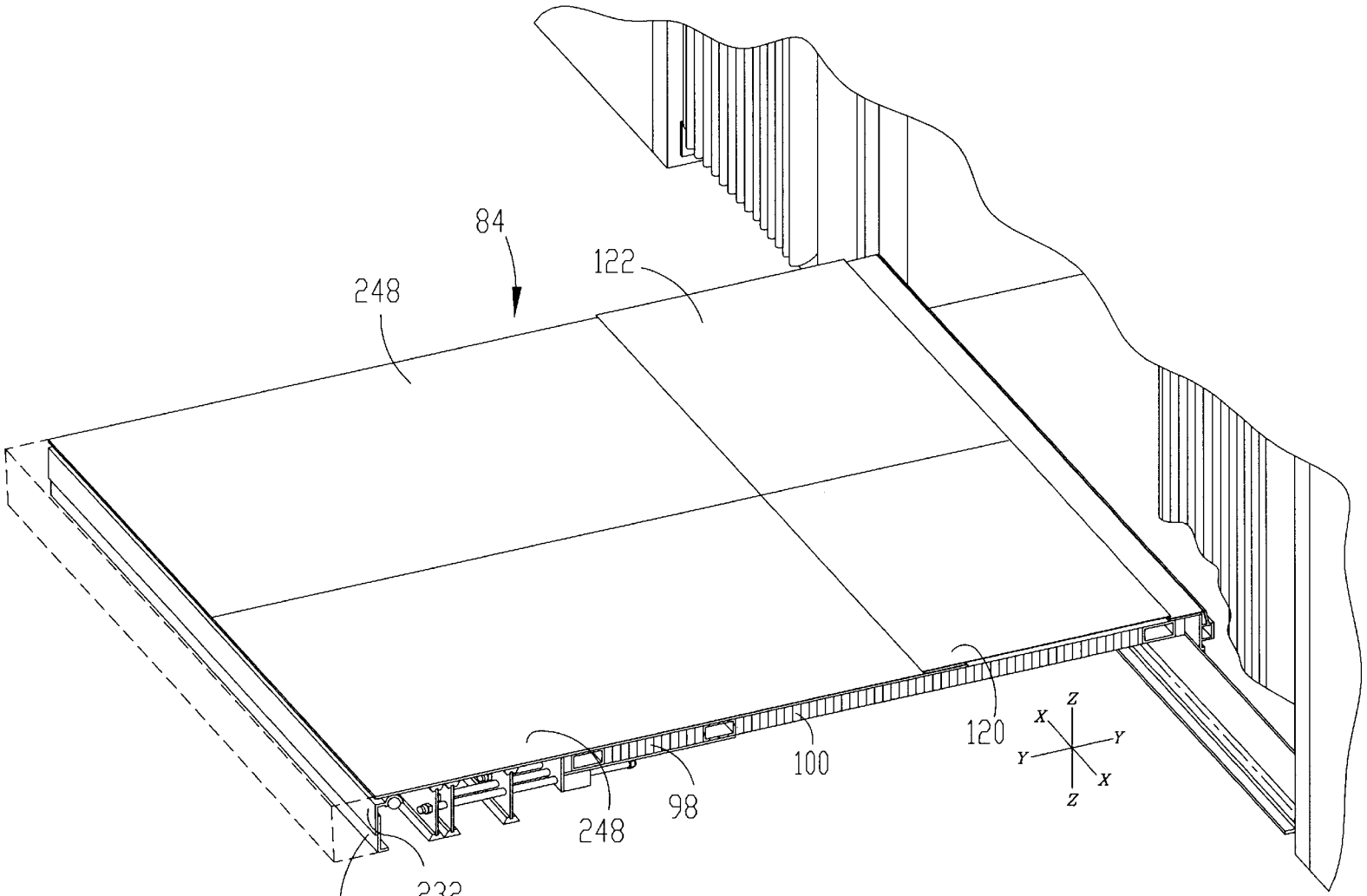
FIG. 16 is a view similar to that of FIG. 8 but depicting accommodation of Y-axis translation.

FIG. 16—Y-Axis Translation

Y-axis translation may occur when the building structures 32 and 34 move toward and away from each other. In such event, the floor panel 84 absorbs such compressive or tensile forces. In the case of compression of the floor panel 84, the interconnected plates 230, 232 first contact outboard support panel 280 and move the panel 280 rightwardly as shown in FIG. 16. This is possible by virtue of the sliding connection with this associated guide pins 278 and (as necessary) movement of axle 286 and the mounting blocks 116 carried thereby. Although not shown fully in FIG. 16, it will be appreciated that the Y-axis translation can be accommodated to the full extent of the spacing between the support panels 280–284, until these panels move together and against the left-hand margin of floor panel 84. During this movement, the slider plate sections 246, 248 move rightwardly, inasmuch as these sections are affixed to plate 232. This motion is accommodated by provision of the floater plate sections 120, 122 which move upwardly allowing the slider plate sections to move beneath the corresponding floater plate sections. Finally, the compressible nature of the honeycomb sections 98, 100 further accommodates Y-axis translation.

In instances where the building structures 32, 34 move apart, the plates 230, 232 move with structure 34, thereby pulling slider plate sections 246, 248 leftwardly as viewed in FIG. 16. This creates a gap (not shown) between the slider plate sections and the adjacent floater plate sections 120, 122. However, the honeycomb section 100 has sufficient strength to accommodate normal pedestrian traffic in such event.

Figure 17:
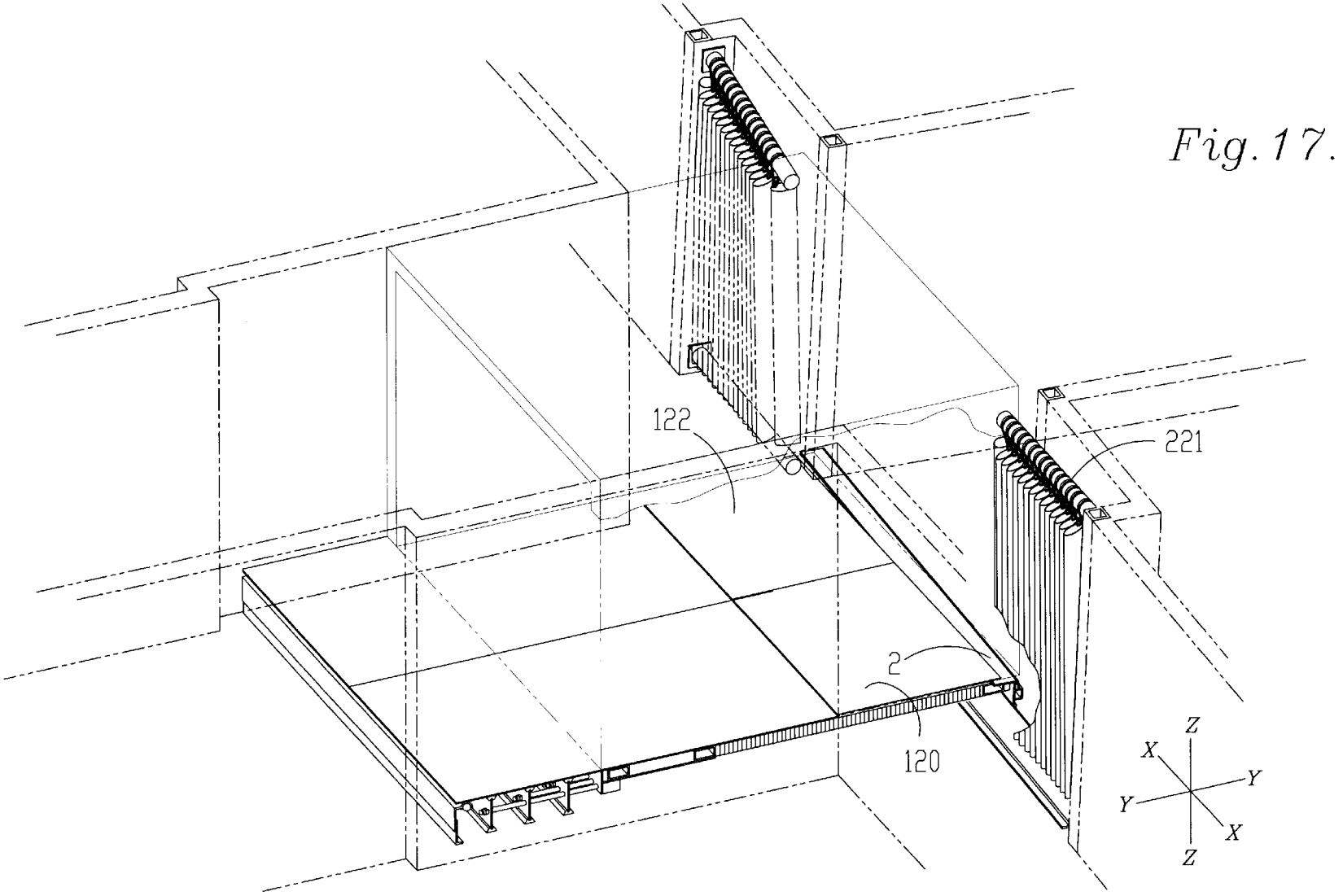
FIG. 17 is an isometric view similar to that of FIG. 1 but depicting the portal assembly in accommodating Z-axis rotation.

FIG. 17—Z-Axis Rotation

Z-axis rotation is accommodated principally by means of the central bearing block 172 and pin 176 carried thereby. That is to say, the upright pin 176 defines the Z-axis of rotation for the assembly 36. The auxiliary pins 188 also move in the event of Z-axis rotation, within the slots defined between segments 198, 200. As further shown in FIG. 17, Z-axis rotation may cause the floater plate sections 120, 122 to ride up over the threshold plate planar segment 210.

We claim:

1. Portal apparatus for spanning the distance between first and second spaced structures subject to sudden movement such as that caused by a seismic event, said apparatus comprising:

an elongated portal assembly presenting a pair of laterally spaced apart side margins and a pair of opposed ends, said portal assembly including an elongated floor panel having opposed floor panel ends and adapted to support traffic thereover between said structures; and means for coupling the opposed ends of said portal assembly to said first and second structures respectively, including means for accommodating significant translation and rotational movement of the portal assembly about three orthogonal axes in space while maintaining the interconnection of the portal assembly with the first and second structures, when the structures and portal assembly are subjected to said sudden movement, said coupling means including means adapted for supporting one end of said portal assembly to the first structure for translational movement thereof along a first axis transverse to the longitudinal axes of the portal assembly, and shiftable curtain means operably coupled with the lateral side margins of said one end of the portal assembly, and adapted for coupling with the first structure, for movement of the curtain means with said one end of said portal assembly along said first axis, said translational movement supporting means including an elongated track pin disposed below said floor panel and transverse to the longitudinal axis thereof, and a main bearing block operably coupled to said floor panel and receiving said track pin for shifting movement therealong, said apparatus further including upright pin means carried by said main bearing block and extending upwardly therefrom and being received by said floor panel for supporting the floor panel for pivotal movement of the portal assembly about a second axis transverse to said first axis and the longitudinal axis of said portal assembly.

2. The portal apparatus as set forth in claim 1, said portal assembly including a pair of upright sidewalls operably coupled with said floor panel, and a ceiling panel extending between and operably coupled with said sidewalls whereby said floor, sidewall and ceiling panels cooperatively present an elongated passageway with opposed portal openings adjacent each end of the portal assembly.

3. The portal apparatus as set forth in claim 1, including a threshold plate operably secured adjacent said first structure proximal to said one end of said portal assembly and extending into overlying contact with said floor panel, there being means resiliently biasing said threshold plate into contact with said floor panel.

4. The portal apparatus as set forth in claim 1, there being a third axis parallel to the longitudinal axis of the portal assembly, said coupling means including:

means securing one end of said portal assembly to said first structure for translational movement of the portal assembly with the first structure along said third axis; and means shiftably supporting the other end of said portal assembly on said second structure for translational shifting movement of the second end of the portal assembly relative to the second structure along said third axis.

5. The portal apparatus as set forth in claim 4, said means shiftably supporting said other end of said portal assembly comprising track means secured to said second structure and beneath said floor panel, and means operably coupled to said floor panel and slidable along said track means.

6. The portal apparatus as set forth in claim 1, said floor panel including a filler segment comprising a compressible, resilient body including a plurality of walls defining a series of openings in the body.

7. The portal apparatus as set forth in claim 6, said floor panel including a plurality of axially spaced apart, transversely extending metallic reinforcing beams, there being a filler segment disposed between respective reinforcing beams.

8. Portal apparatus for spanning the distance between first and second spaced structures subject to sudden movement such as that caused by a seismic event, said apparatus comprising:

an elongated portal assembly presenting a pair of laterally spaced apart side margins and a pair of opposed ends, said portal assembly including an elongated floor panel having opposed floor panel ends and adapted to support traffic thereover between said structures; and means for coupling the opposed ends of said portal assembly to said first and second structures respectively, including means for accommodating significant translation and rotational movement of the portal assembly about three orthogonal axes in space while maintaining the interconnection of the portal assembly with the first and second structures, when the structures and portal assembly are subjected to said sudden movement, said coupling means including means adapted for supporting one end of said portal assembly to the first structure for translational movement thereof along a first axis transverse to the longitudinal axes of the portal assembly; and shiftable curtain means operably coupled with the lateral side margins of said one end of the portal assembly, and adapted for coupling with the first structure, for movement of the curtain means with said one end of said portal assembly along said first axis, said translational movement supporting means including an elongated track pin disposed below said floor panel and transverse to the longitudinal axis thereof, and a main bearing block operably coupled to said floor panel and receiving said track pin for shifting movement therealong, said main bearing block being pivotal about the longitudinal axis of said track pin for supporting said portal assembly for pivotal movement about said said longitudinal axis of said track pin, said apparatus including a pair of auxiliary bearing blocks disposed on opposite sides of and in spaced relationship to said main bearing block, said auxiliary bearing blocks being operably coupled to said floor panel and receiving and being translatable along the length of and pivotal about said track pin, there being upright secondary pins carried by each of said auxiliary bearing blocks and received by said floor panel, there being a structure defining a secondary pin track within said floor panel and adjacent each of the secondary pins for permitting movement of each of the secondary pins within the corresponding track upon said pivotal movement of the portal assembly about said second axis.

9. The portal apparatus as set forth in claim 8, said portal assembly including a pair of upright sidewalls operably coupled with said floor panel, and a ceiling panel extending between and operably coupled with said sidewalls whereby said floor, sidewall and ceiling panels cooperatively present an elongated passageway with opposed portal openings adjacent each end of the portal assembly.

10. The portal apparatus as set forth in claim 8, including a threshold plate operably secured adjacent said first structure proximal to said one end of said portal assembly and extending into overlying contact with said floor panel, there being means resiliently biasing said threshold plate into contact with said floor panel.

11. The portal apparatus as set forth in claim 8, including upright pin means carried by said main bearing block and extending upwardly therefrom and being received by said floor panel for supporting the floor panel for pivotal movement of the portal assembly about a second axis transverse to said first axis and the longitudinal axis of said portal assembly.

12. The portal apparatus as set forth in claim 8, there being a third axis parallel to the longitudinal axis of the portal assembly, said coupling means including means securing one end of said portal assembly to said first structure for translational movement of the portal assembly with the first structure along said third axis, and means shiftably supporting the other end of said portal assembly on said second structure for translational shifting movement of the second end of the portal assembly relative to the second structure along said third axis.

13. The portal apparatus as set forth in claim 12, said means shiftably supporting said other end of said portal assembly comprising track means secured to said second structure and beneath said floor panel, and means operably coupled to said floor panel and slidable along said track means.

14. Portal apparatus for spanning the distance between first and second spaced structures subject to sudden movement such as that caused by a seismic event, said apparatus comprising:

an elongated portal assembly presenting a pair of laterally spaced apart side margins and a pair of opposed ends, said portal assembly including an elongated floor panel having opposed floor panel ends and adapted to support traffic thereover between said structures; and means for coupling the opposed ends of said portal assembly to said first and second structures respectively, including means for accommodating significant translation and rotational movement of the portal assembly about three orthogonal axes in space while maintaining the interconnection of the portal assembly with the first and second structures, when the structures and portal assembly are subjected to said sudden movement, there being a third axis parallel to the longitudinal axis of the portal assembly, said coupling means including means securing one end of said portal assembly to said first structure for translational movement of the portal assembly with the first structure along said third axis, and means shiftably supporting the other end of said portal assembly on said second structure for translational shifting movement of the second end of the portal assembly relative to the second structure along said third axis, said means shiftably supporting said other end of said portal assembly including a plurality of elongated, spaced apart, upright support beams oriented with the longitudinal axes thereof transverse to said third axis and disposed in laterally spaced relationship to the second floor panel end proximal to said second structure, a guide rod for each of said support beams, each of said guide rods being operably secured to said second floor panel end and slidably received by a corresponding support beam for guiding the movement of the support beams along said third axis, and slider plate means operably coupled with said second structure and extending over said support beams and engaging said floor panel.

15. The portal apparatus as set forth in claim 14, including a floater plate disposed atop said floor panel and being coupled to the floor panel for limited lifting movement of the floater plate relative to the floor panel, said floater plate being oriented relative to said slider plate for permitting the slider plate to move beneath the floater plate during movement of the slider plate along said third axis.

16. The portal apparatus as set forth in claim 14, said portal assembly including a pair of upright sidewalls operably coupled with said floor panel, and a ceiling panel extending between and operably coupled with said sidewalls whereby said floor, sidewall and ceiling panels cooperatively present an elongated passageway with opposed portal openings adjacent each end of the portal assembly.

17. The portal apparatus as set forth in claim 14, said coupling means including means adapted for supporting one end of said portal assembly to the first structure for translational movement thereof along a first axis transverse to the longitudinal axes of the portal assembly, and shiftable curtain means operably coupled with the lateral side margins of said one end of the portal assembly, and adapted for coupling with the first structure, for movement of the curtain means with said one end of said portal assembly along said first axis.

18. The portal apparatus as set forth in claim 17, said translational movement supporting means including an elongated track pin disposed below said floor panel and transverse to the longitudinal axis thereof, and a main bearing block operably coupled to said floor panel and receiving said track pin for shifting movement therealong.

19. The portal apparatus as set forth in claim 18, said main bearing block being pivotal about the longitudinal axis of said track pin for supporting said portal assembly for pivotal movement about said longitudinal axis of said track pin.

20. The portal apparatus as set forth in claim 19, including a threshold plate operably secured adjacent said first structure proximal to said one end of said portal assembly and extending into overlying contact with said floor panel, there being means resiliently biasing said threshold plate into contact with said floor panel.

21. The portal apparatus as set forth in claim 18, including upright pin means carried by said main bearing block and extending upwardly therefrom and being received by said floor panel for supporting the floor panel for pivotal movement of the portal assembly about a second axis transverse to said first axis and the longitudinal axis of said portal assembly.

22. The portal apparatus as set forth in claim 19 including a pair of auxiliary bearing blocks disposed on opposite sides of and in spaced relationship to said main bearing block, said auxiliary bearing blocks being operably coupled to said floor panel and receiving and being translatable along the length of and pivotal about said track pin, there being upright secondary pins carried by each of said auxiliary bearing blocks and received by said floor panel, there being a structure defining a secondary pin track within said floor panel and adjacent each of the secondary pins for permitting movement of each of the secondary pins within the corresponding track upon said pivotal movement of the portal assembly about said second axis.

* * * * *